US005086631A

United States Patent [19]

Agbay

[11] Patent Number: 5,086,631

[45] Date of Patent: Feb. 11, 1992

[54] DISC CYLINDER LOCK

[75] Inventor: Anthony J. Agbay, Auburn, Mass.

[73] Assignee: Olson Manufacturing Co., Holden, Mass.

[21] Appl. No.: 550,325

[22] Filed: Jul. 9, 1990

[51] Int. Cl.[5] ..... E05B 15/14

[52] U.S. Cl. ..... 70/366; 70/377; 70/392

[58] Field of Search ..... 70/366, 421, 377, 365, 70/386, 392

[56] References Cited

U.S. PATENT DOCUMENTS

| | | | |
|---|---|---|---|
| 3,621,689 | 11/1971 | Koskinen | 70/366 |
| 3,821,886 | 7/1974 | Ladewig | 70/366 |
| 4,109,495 | 8/1978 | Roberts | 70/377 |
| 4,267,717 | 5/1981 | Martikainen | 70/377 |
| 4,418,555 | 12/1983 | Uyeda | 70/377 |
| 4,512,166 | 4/1985 | Dunphy et al. | 70/377 |
| 4,637,234 | 1/1987 | Mielonen | 70/34 |
| 4,637,240 | 7/1987 | Nevalainen et al. | 70/377 |
| 4,742,703 | 5/1988 | DeWalch et al. | 70/366 |

*Primary Examiner*—Lloyd A. Gall
*Assistant Examiner*—Darnell M. Boucher
*Attorney, Agent, or Firm*—Samuels, Gauthier & Stevens

[57] ABSTRACT

The lifting and rotating zeroes and the combination discs of a disc cylinder lock are provided with curved internal camming surfaces designed to mate with external curved camming surfaces on the key shank. The curved camming surfaces consist of segments of mathematically defined spirals, with non-uniform radii as measured from the lock axis.

3 Claims, 5 Drawing Sheets

DISC CYLINDER LOCK

BACKGROUND OF THE INVENTION

1. Field of the Invention

This invention relates generally to disc cylinder locks, and is concerned in particular with an improvement designed to render it extremely difficult and in most cases virtually impossible to counterfeit the keys used to operate such locks.

2. Description of the Prior Art

Disc cylinder locks are well known and have been in widespread use for over seventy years. Examples of recent developments in locks of this type are described in U.S. Pat. Nos. 4,637,234 and 4,742,703.

The conventional disc cylinder lock typically comprises a tubular lock barrel containing a rotatable cylinder. The barrel has a longitudinally extending internal groove and the cylinder has a parallel slot containing a radially shiftable locking bar. The cylinder further contains a series of axially stacked independently rotatable operating discs having mutually aligned specially configured central apertures defining a keyway. The peripheral edges of the discs are interrupted by notches and the lock is operated by a key insertable in the keyway. The key has a series of longitudinally spaced angularly offset external flats, each being arranged to mate with an internal flat bordering the central aperture of a respective one of the operating discs. When the discs are "scrambled", at least some of their peripheral notches are out of radial alignment with the cylinder slot, with the result that the locking bar is urged outwardly and caused to protrude from the cylinder slot into the internal barrel groove, thereby preventing the cylinder from turning in the barrel. Rotation of the key brings the respective external and internal mating flats of the key and discs into coactive engagement, causing the discs to rotate until their respective peripheral notches are all in radial alignment with the cylinder slot, at which point the locking bar is permitted to shift radially inwardly from the barrel groove. This frees the cylinder to turn within the barrel.

It will thus be seen that the operating discs act in a similar manner to tumblers in a safe, making the lock extremely difficult to pick. Moreover, by varying the number of operating discs and/or the orientation of the mating sets of internal disc flats and external key flats, a myriad of combinations can be developed. This latter feature is important in applications where it is desirable to provide each lock and key set with its own unique combination.

However, there are other applications, such as for example in security systems for public utility meters, where tens of thousands of identical locks must be provided with the same combination so that all may be operated by identical keys distributed to utility personnel. Here, a major concern centers on preventing genuine keys from being counterfeited. Once this happens, the integrity of the entire system is compromised, thus making it necessary to replace all of the locks.

The problem with conventional disc cylinder locks is that the arrangement of angularly offset external flats on their operating keys is relatively easy to copy. This can be done most readily by taking measurements directly from a genuine key, but it can also be accomplished by dismantling a lock and taking measurements from the internal flats on the operating discs. Because of this problem, public utilities have been reluctant to employ disc cylinder locks in their security systems.

SUMMARY OF THE INVENTION

The primary objective of the present invention is to introduce complexities into the design of the internal discs and the key in order to render it extremely difficult if not impossible to subsequently develop a counterfeit key by copying these components.

A companion objective of the present invention is to significantly increase the difficulty of producing counterfeit keys without making major alterations t the basic lock design and without increasing its cost of manufacture.

These and other objectives and advantages are achieved by replacing the conventional external flats on the key and the internal flats bordering the central apertures of the operating discs with specially curved camming surfaces. Preferably the camming surfaces have gradually varying radii as measured from the central lock axis. Typically, the camming surfaces will comprise segments of spirals, the development of which is based on a mathematical equation known only to the lock manufacturer. Those familiar with machine shop practices will appreciate that spirals are extremely difficult to reproduce from direct measurements. Practically speaking, therefore, without access to the basic mathematical equation governing the design of the camming surfaces, it becomes virtually impossible to develop counterfeit keys.

A preferred embodiment of the present invention will now be described in greater detail with reference to the accompanying drawings, wherein:

DETAILED DESCRIPTION OF ILLUSTRATED EMBODIMENT

Figure 1:
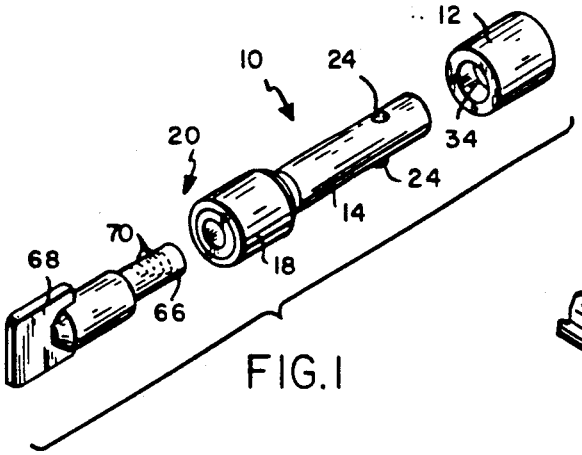
FIG. 1 is an exploded view of a barrel lock incorporating a disc cylinder lock and key combination in accordance with the present invention.
Figure 1A:
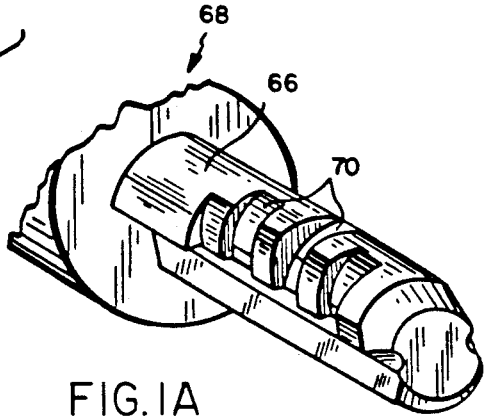
FIG. 1A is an enlarged three dimensional view of the key shank.
Figure 2:
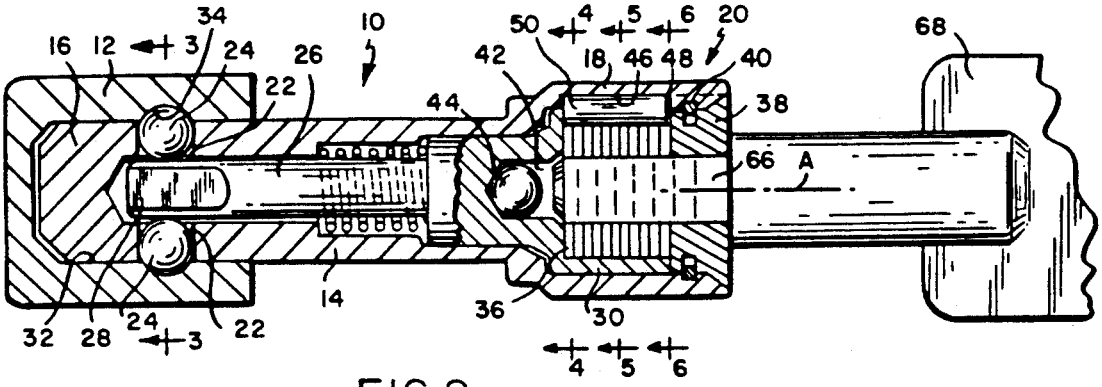
FIG. 2 is a longitudinal sectional view through the assembled lock components of FIG. 1, with the key operatively inserted in the disc cylinder lock.
Figure 2A:
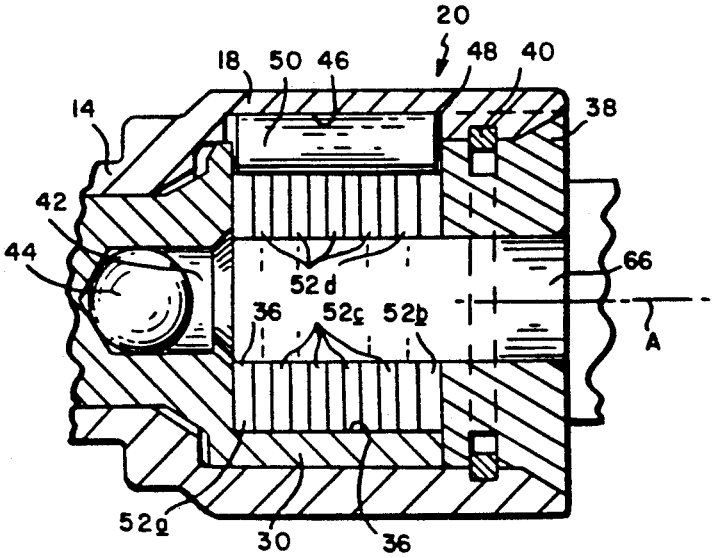
FIG. 2A is an enlarged view of a portion of FIG. 2 showing the major components of the disc cylinder lock.

Referring initially to FIGS. 1-2A, a lock and key combination in accordance with the present invention is shown comprising a barrel lock 10 adapted to coact in a known conventional manner in interlocked engagement with an end cap 12. The barrel lock has a tubular shank 14 closed at one end as at 16 and communicating at its opposite end with the tubular barrel 18 of a disc cylinder lock 20 of the present invention.

The tubular shank has a pair of oppositely disposed radial openings 22 containing locking balls 24. An operating stem 26 is rotatably contained within the shank 14. The inner end of the stem has oppositely facing flats 28, with the outer end of the stem being integrally joined to the cylinder 30 of the disc cylinder lock 20.

The end cap 12 has a blind bore 32 with an internal circular groove 34. When the barrel lock 10 and end cap 12 are assembled in interlocked engagement as shown for example in FIGS. 2 and 3A, the cylindrical surfaces of the stem 26 between the flats 28 urge the locking balls 24 radially outwardly into the internal groove 34 of the end cap, thus preventing the shank 14 from being withdrawn from the blind bore 32. As shown in FIG. 3C, a 90° rotation of the stem 26 positions the flats 28 under the locking balls 24, thereby allowing the balls to be cammed radially inwardly out of the internal groove 34. This clears the way for axial separation of the shank 14 from the bore 32.

The cylinder 30 has an enlarged diameter chamber 36 closed at its outer end by an end wall 38 secured in place by a snap ring 40. Chamber 36 communicates at its inner end with a blind bore 42. A hardened steel ball 44 is located at the base of the blind bore 42. The purpose of the ball 44 is to thwart attempts at drilling out the lock.

The barrel 18 has a longitudinally extending internal groove 46, and the cylinder has a parallel slot 48 containing a radially shiftable locking bar 50. A series of independently rotatable elements 52 are arranged in a stacked relationship within the chamber 36. These include a "lifting zero" 52*a* at the inner end of the chamber, a "rotating zero" 52*b* at the outer end of the chamber, and a plurality of "combination discs" 52*c* located between the two zeros. The combination discs are separated from each other and from the zeros by centrally apertured washers 52*d*. The washers merely serve as spacers and thus need not be described in any further detail.

Figure 7:
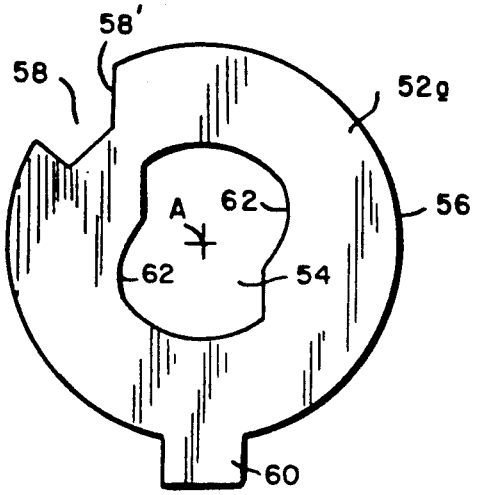
FIGS. 7, 8 and 9 are enlarged views respectively of the lifting zero, and a typical combination disc.

The lifting zero 52*a* is illustrated in more detail in FIG. 7 as having a generally annular configuration with a central aperture 54, and a circular peripheral edge 56 interrupted at angularly separated locations by a lifting notch 58 and a radially protruding tab 60. The lifting notch 58 is partially defined by an angled lifted edge 58', the function of which will hereinafter be described in further detail. The central aperture 54 is at least partially bordered by internal camming surfaces 62 located 180° apart.

Figure 8:
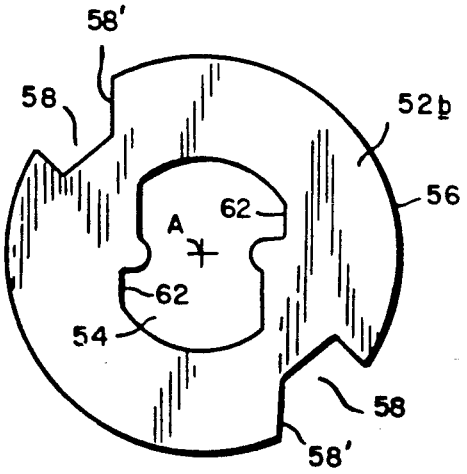

The rotating zero 52*b* is shown in FIG. 8. It too has a generally annular configuration with a central aperture 54 and a circular peripheral edge 56 interrupted by two lifting notches 58, at 180° intervals. The notches 58 are identical to the notch 58 in the lifting zero, each being partially defined by an angled lifting edge 58', and the central aperture 54 is again at least partially bordered by internal camming surfaces 62.

Figure 9:
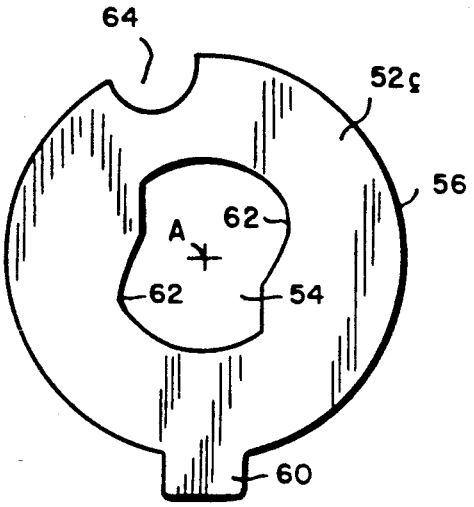

A typical combination disc 52*c* is shown in FIG. 9 as having a generally annular configuration, with a central aperture 54, and a circular peripheral edge 56 interrupted by a combination notch 64 and a tab 60. The central aperture 54 is again at least partially bordered by internal camming surfaces 62. It will be understood that the combination discs 52*c* differ one from the other in the orientation of their notches 64 and the shape and orientation of their camming surfaces 62.

The central apertures 54 of the lifting and rotating zeros 52*a*, 52*b* as well as those of the combination discs 52*c* and spacer washers 52*d* are aligned axially within the cylinder chamber 36 to define a keyway. The keyway is designed to accept the shank 66 of a key 68 used to operate the lock. The key shank 66 is provided with longitudinally spaced sets of external camming surfaces 70. The sets of external camming surfaces 70 differ one from the other, each set being configured to coact with a complimentary internal set of internal camming surfaces 62 on a respective one of the lifting and rotating zeros 52*a*, 52*b* and the combination discs 52*c*.

Preferably, the internal and external camming surfaces 62, 70 comprise segments of spirals, each such segment thus being curved with a non-uniform radius of curvature as measured from the central lock axis "A". Typically, the spirals will be defined by a selected mathematical equation, one example being $$R = C \cdot <$$

where:

R = radius

C = a numerical constant

< = the angle of the radius in degrees.

Figure 10:
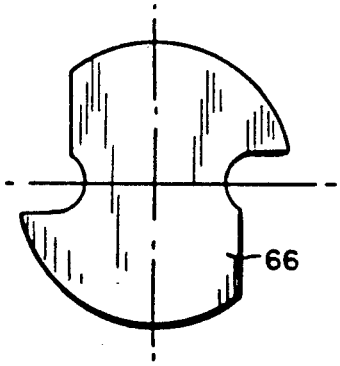
FIG. 10 is a cross-sectional view taken through a typical blank key shank prior to its having external camming surfaces machined therein.
Figure 11A:
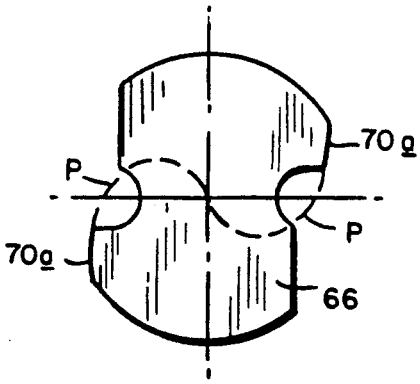
FIGS. 11A-11F are sectional views taken through the key shank and depicting the machining therein of a series of external camming surfaces based on a common spiral configuration.
Figure 11B:
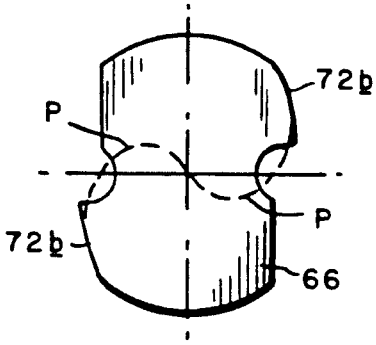
Figure 11C:
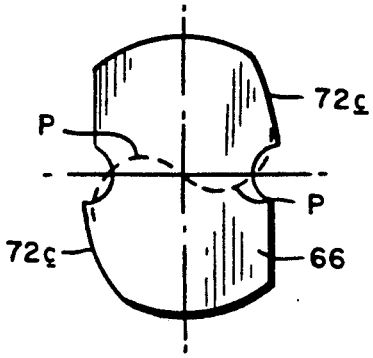
Figure 11D:
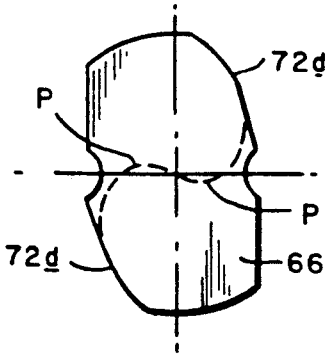
Figure 11E:
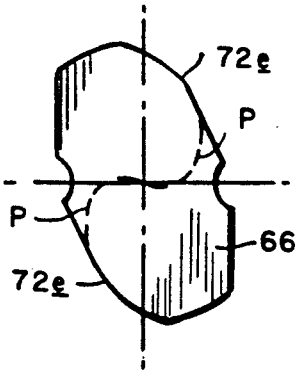
Figure 11F:
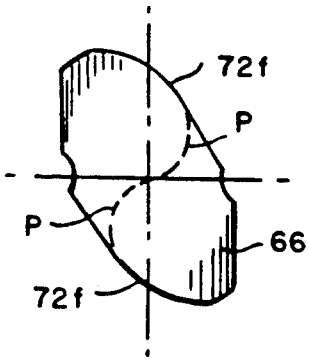

FIG. 10 is a cross-sectional view of a typical blank key shank 66 prior to its being machined to produce the desired series of external camming surfaces 70. FIG. 11A shows the blank machined along spiral paths "P" to produce external camming surfaces 70*a* at one location along the length of the key shank. FIGS. 11B to 11F respectively show external camming surfaces 70*b*–70*f* at other locations along the key shank, each resulting from machining along the same spiral paths P, with the paths P having been progressively rotated in the counterclockwise direction.

The shape and angular orientation of each set of external camming surfaces 70 is designed to coact with a mating set of internal camming surfaces 62 on the rotating and lifting zeros and the combination discs.

Figure 3A:
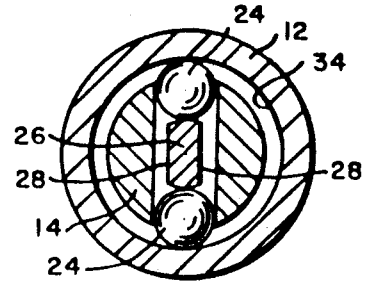
FIGS. 3A-3F, 4A-4F, 5A-5F and 6A-6F are cross sectional views taken respectively along lines 3—3, 4—4, 5—5 and 6—6 of FIG. 2, depicting various stages in the unlocking and locking of the disc cylinder lock.
Figure 4A:
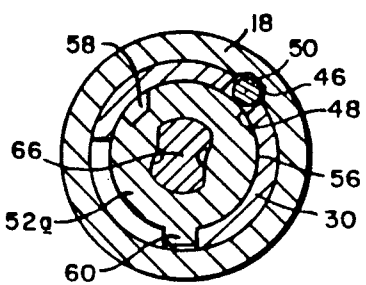
Figure 6A:
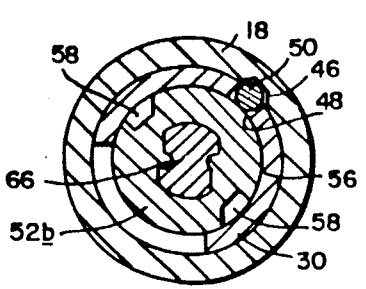
Figure 5A:
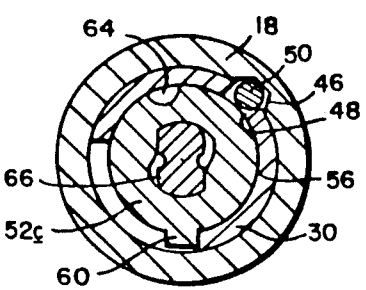

FIGS. 3A–6F illustrate the operation of the disc cylinder lock in concert with associated components of the barrel lock. FIGS. 3A–6A illustrate the locked condition. In FIG. 3A, the circular segments of the stem 26 are shown urging the locking balls 24 outwardly into the internal groove 34 of the end cap 12, thus preventing the tubular shank 14 from being withdrawn. FIGS. 4A and 6A show the respective positions of the lifting and rotating zeros 52*a*, 52*b* and FIG. 5A shows the position of a typical combination disc 52*c*. The locking bar 50 rides on the peripheral circular edges 56 of the zeros 52*a*, 52*b* and combination discs 52*c*, and is thus pushed into the internal barrel groove 46.

In FIGS. 3B to 6B, the key shank 66 has been rotated 90° in the clockwise direction. The relative positions of the locking balls 24 and stem 26 remain unchanged. However, the rotating and lifting zeros 52*a*, 52*b* and the combination discs 52*c* have been rotated as a result of their internal camming surfaces 62 having been engaged by the external camming surfaces 70 of the key shank, with the result that all notches 58, 64 are aligned with each other and with the locking bar 50, thereby permitting the locking bar to shift radially inwardly out of the internal barrel groove 46 and further into the cylinder slot 48.

In FIGS. 3C to 6C, the key has been rotated a further 90° in the clockwise direction. Because of the interlocked relationship between the zeros 52*a*, 52*b*, discs 52c and the cylinder 30 via the locking bar 50, the latter now being free of the barrel groove 46, the cylinder and its integral stem 26 also rotate 90°. This positions the stem flats 28 under the locking balls 24, thus clearing the way for the locking balls to be cammed inwardly out of the internal groove 34 of the end cap 12. The lock is thus unlocked.

Figure 3B:
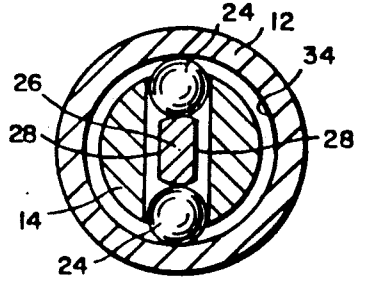
Figure 4B:
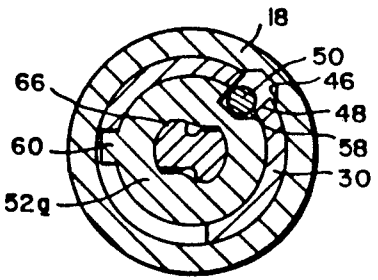
Figure 6B:
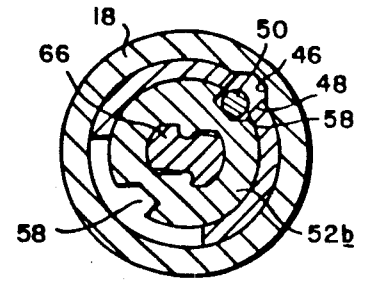
Figure 5B:
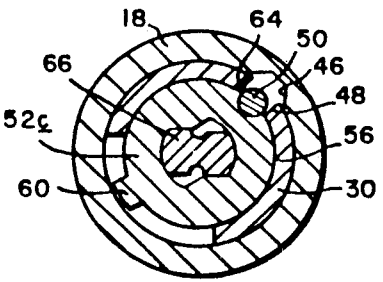
Figure 3C:
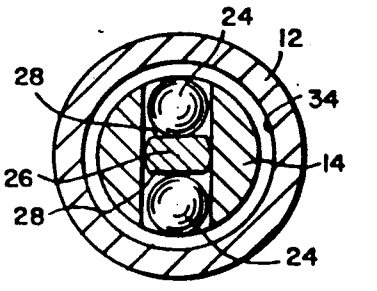
Figure 4C:
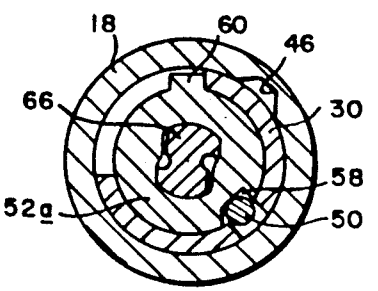
Figure 6C:
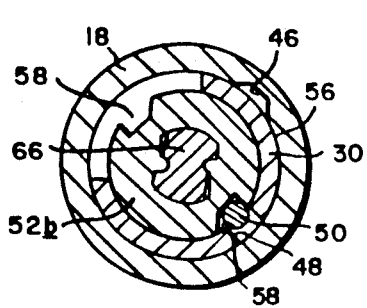
Figure 5C:
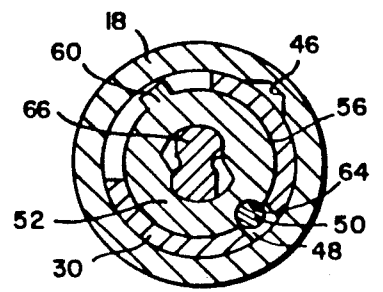
Figure 3D:
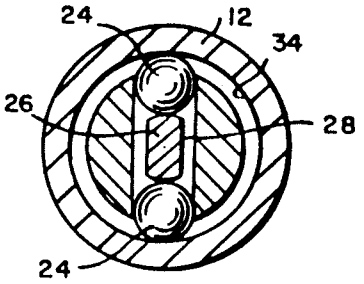
Figure 4D:
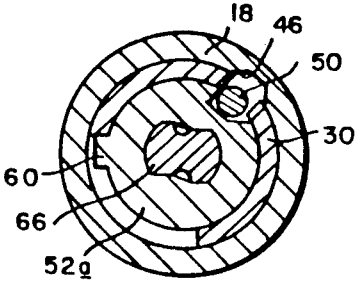
Figure 5D:
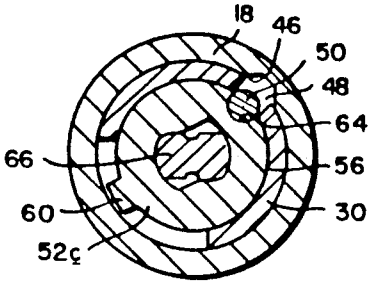
Figure 6D:
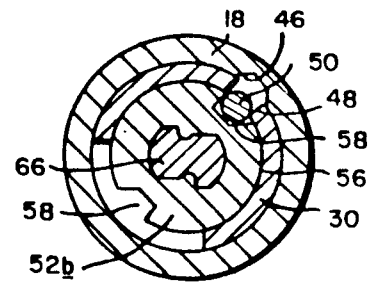
Figure 3E:
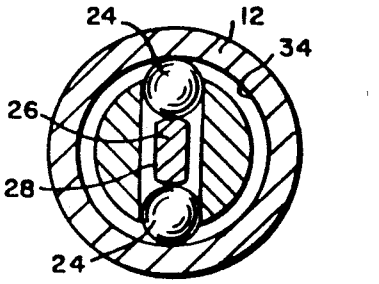
Figure 4E:
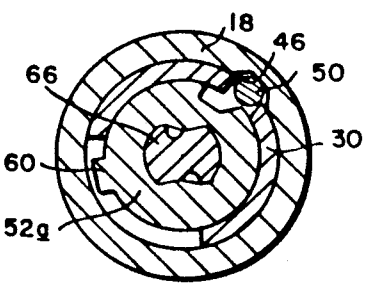
Figure 5E:
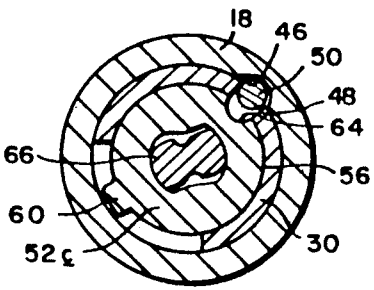
Figure 6E:
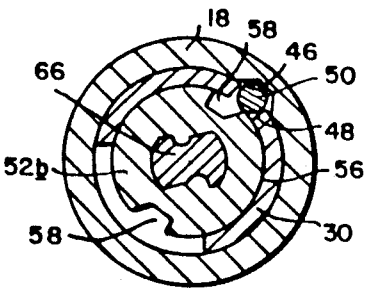
Figure 3F:
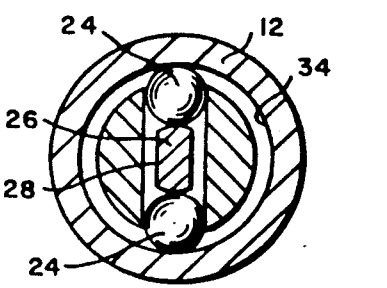
Figure 4F:
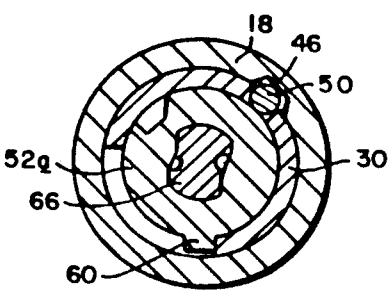
Figure 5F:
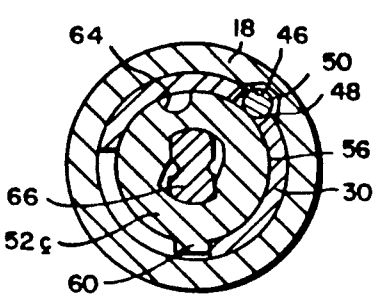
Figure 6F:
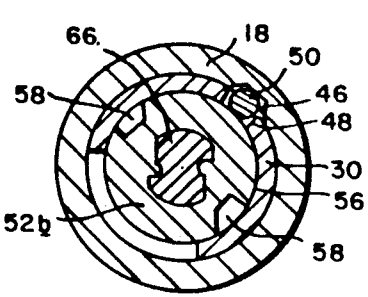

FIGS. 3D to 6D ar identical to FIGS. 3B and 6B and show how the barrel lock components are returned to the locked position by rotating the key 90° in the counterclockwise direction.

In FIGS. 3E to 6E, the key has been rotated another 15° in the counterclockwise direction. This causes the lifting and rotating zeros 52a, 52b to rotate with the key, while the combination discs 52c remain stationary. When this happens, the inclined flanks 58' on the lifting notches 58 of the zeros 52a, 52b cam the locking bar 50 radially outwardly into the internal barrel groove 46.

In FIGS. 3F to 6F, the key has been rotated a further 75° in the counterclockwise direction to rescramble the combination discs 52c, thus returning all components to the original positions as shown in FIGS. 3A-6A.

In light of the foregoing, it will now be appreciated by those skilled in the art that the coacting internal and external camming surfaces 62, 70 of the rotating lock elements 52 and the key shank 66 all comprise curved surfaces selected for their difficulty to be reproduced by direct measurements. Preferably, the curved surfaces comprise segments of mathematically defined spirals. As illustrated in FIGS. 11A-11F, all of the camming surfaces of a particular lock may lie on one spiral which has been rotated to provide varying shapes and angular orientations. Alternatively, however, multiple spirals based on different mathematical equations may be incorporated in a single lock design.

The mating internal and external spirals must coact precisely, for otherwise the resulting rotative adjustments of the zeros and combination discs will not achieve the alignment of notches required to shift the locking bar into and out of interlocked engagement between the lock barrel and cylinder. Such precise coaction requires careful machining of the camming surfaces. This can readily be done if the mathematical equations governing the development of the spiral shapes are known. Without this knowledge, however, it is difficult if not impossible to reliably reproduce the camming surfaces by measuring physical components.

I claim:

1. A disc cylinder lock and key combination comprising:

(a) a tubular barrel having an internal groove extending longitudinally in parallel relationship to the lock axis;

(b) a cylinder received in said barrel for rotation about said axis, said cylinder having a slot extending in parallel relationship to said axis;

(c) a locking bar located in said slot;

(d) disc means for radially shifting said locking bar between an outer position partially extending from said slot into said groove to prevent rotation of said cylinder relative to said barrel about said axis, and an inner position recessed within said slot and clear of said groove to permit said rotation, said disc means including a plurality of independently rotatable discs arranged along said axis within said cylinder, said discs having coaxially aligned central apertures and outer peripheral edges interrupted by notches, said discs being rotatably adjustable between;

(i) a first setting at which at least some of said discs are arranged with their notches angularly misaligned with respect to said slot, and with their peripheral edges bearing against and holding said locking bar in said outer position; and, (ii) a second setting at which the notches of all of said discs are aligned longitudinally with each other as well as radially with said slot to thereby accommodate shifting of said locking bar from said outer position to said inner position; and a key having a longitudinally extending shank receivable in said cylinder in a fully inserted position extending through the coaxially aligned central apertures of said discs, said shank having a plurality of longitudinally offset spiral external camming surfaces, each of said external camming surfaces being located in a plane of a respective one of said discs when said key is in said fully inserted position, each external camming surface being arranged to mate with a substantially identical spiral internal camming surface bordering the central aperture of the respective one of said discs and to coact therewith in response to rotation of said key to rotate said discs between said first and second settings.

2. The lock and key combination of claim 1 wherein each of said central apertures is bordered by at least two angularly offset spiral internal camming surfaces arranged to mate with a corresponding number of external spiral camming surfaces on said shank.

3. A disc cylinder lock and key combination comprising:

(a) a tubular barrel having an internal groove extending longitudinally in parallel relationship to the lock axis;

(b) a cylinder received in said barrel for rotation about said axis, said cylinder having a slot extending in parallel relationship to said axis;

(c) a locking bar located in said slot;

(d) disc means for radially shifting said locking bar between an outer position partially extending from said slot into said groove to prevent rotation of said cylinder relative to said barrel about said axis, and an inner position recessed within said slot and clear of said groove to permit said rotation, said disc means including a plurality of independently rotatable discs arranged along said axis within said cylinder, said discs having coaxially aligned central apertures and outer peripheral edges interrupted by notches, said discs being rotatably adjustable between;

(i) a first setting at which at least some of said discs are arranged with their notches angularly misaligned with respect to said slot, and with their peripheral edges bearing against and holding said locking bar in said outer position; and, (ii) a second setting at which the notches of all of said discs are aligned longitudinally with each other as well as radially with said slot to thereby accommodate shifting of said locking bar from said outer position to said inner position; and a key having a longitudinally extending shank insertable into a first position extending through the coaxially aligned central apertures of said discs with said discs being arranged at said first setting, said shank having longitudinally offset spiral external camming surfaces which in response to rotation of said key in one direction from said first position to a second position, are arranged to mate with spiral internal camming surface bordering the central apertures of said discs to rotate said discs to said second setting, whereupon further rotation of said shank in said one direction will cause said cylinder to rotate in relation to said barrel.

* * * * *